US011375603B2

(12) United States Patent
Morie et al.

(10) Patent No.: US 11,375,603 B2
(45) Date of Patent: Jun. 28, 2022

(54) CYCLOTRON

(71) Applicant: SUMITOMO HEAVY INDUSTRIES, LTD., Tokyo (JP)

(72) Inventors: Takaaki Morie, Kanagawa (JP); Akito Higuchi, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 71 days.

(21) Appl. No.: 17/004,816

(22) Filed: Aug. 27, 2020

(65) Prior Publication Data

US 2021/0068243 A1 Mar. 4, 2021

(30) Foreign Application Priority Data

Aug. 28, 2019 (JP) ..... JP2019-155843

(51) Int. Cl.
*H05H 13/00* (2006.01)
*H05H 7/04* (2006.01)

(52) U.S. Cl.
CPC ..... *H05H 13/005* (2013.01); *H05H 7/04* (2013.01); *H05H 2007/043* (2013.01); *H05H 2007/046* (2013.01); *H05H 2007/048* (2013.01)

(58) Field of Classification Search
None
See application file for complete search history.

(56) References Cited

U.S. PATENT DOCUMENTS 7,541,905 B2 * 6/2009 Antaya ..... H05H 7/04 313/62
7,656,258 B1 * 2/2010 Antaya ..... H05H 13/02 335/216
7,696,847 B2 * 4/2010 Antaya ..... H05H 7/04 335/216
8,525,448 B2 * 9/2013 Tanaka ..... H05H 13/005 315/502
8,614,612 B2 * 12/2013 Antaya ..... H05H 13/02 335/216
8,791,656 B1 * 7/2014 Zwart ..... H05H 7/04 315/503
9,041,318 B2 * 5/2015 Miyashita ..... H05H 13/005 315/502
9,055,662 B2 * 6/2015 Kleeven ..... H05H 13/00
9,095,036 B2 * 7/2015 Johnstone ..... H05H 13/085
9,159,544 B2 * 10/2015 Ding ..... H01J 49/0031
10,306,745 B2 * 5/2019 Aoki ..... H05H 7/02
10,722,735 B2 * 7/2020 Gall ..... H05H 7/04
10,857,389 B2 * 12/2020 Song ..... A61N 5/107
(Continued)

FOREIGN PATENT DOCUMENTS

JP S62-012299 A 1/1987

*Primary Examiner* — Srinivas Sathiraju
(74) *Attorney, Agent, or Firm* — Michael Best & Friedrich LLP

(57) ABSTRACT

There is provided a cyclotron which accelerates a charged particle in an orbital trajectory to emit a charged particle beam. The cyclotron includes a magnetic pole that generates a magnetic field required for accelerating the charged particle, and a magnetic channel portion having a magnetic channel disposed on an outer peripheral portion of the orbital trajectory to guide the charged particle beam to an extraction trajectory and to focus the charged particle beam. The magnetic channel portion is attached to the magnetic pole.

14 Claims, 4 Drawing Sheets

(56) References Cited

U.S. PATENT DOCUMENTS

| | | | | |
|---|---|---|---|---|
| 2007/0171015 | A1* | 7/2007 | Antaya | H05H 7/04 335/216 |
| 2010/0282979 | A1* | 11/2010 | Norling | H05H 7/00 250/396 ML |
| 2011/0068717 | A1* | 3/2011 | Kleeven | H05H 13/00 315/502 |
| 2012/0142538 | A1* | 6/2012 | Antaya | H05H 7/04 505/211 |
| 2014/0094371 | A1* | 4/2014 | Zwart | H01F 6/06 505/180 |
| 2015/0084548 | A1* | 3/2015 | Hara | H05H 13/005 315/501 |
| 2015/0231411 | A1* | 8/2015 | O'Neal, III | A61N 5/1043 600/1 |
| 2016/0353562 | A1* | 12/2016 | Antaya | A61N 5/1043 |
| 2017/0182338 | A1* | 6/2017 | Zwart | H05H 13/02 |
| 2017/0199506 | A1* | 7/2017 | Jones | H02K 11/215 |
| 2017/0330739 | A1* | 11/2017 | Hosaka | H05H 5/03 |
| 2017/0332474 | A1* | 11/2017 | Abs | H05H 7/10 |
| 2019/0239333 | A1* | 8/2019 | Aoki | H05H 7/08 |
| 2020/0128659 | A1* | 4/2020 | Hori | A61N 5/1077 |
| 2021/0068243 | A1* | 3/2021 | Morie | H05H 7/10 |

* cited by examiner

CYCLOTRON

RELATED APPLICATIONS

The content of Japanese Patent Application No. 2019-155843, on the basis of which priority benefits are claimed in an accompanying application data sheet, is in its entire incorporated herein by reference.

BACKGROUND

Technical Field

A certain embodiment of the present invention relates to a cyclotron.

Description of Related Art

In the related art, as a technology in this field, a cyclotron is known. The cyclotron includes a magnetic channel for focusing a charged particle beam and transferring the charged particle beam to an extraction trajectory. A position adjustment mechanism of the magnetic channel is provided outside an acceleration space of the charged particle, and the position adjustment mechanism is held by a casing of a vacuum chamber, for example. The position adjustment mechanism extends in a radial direction on an outer peripheral side of the acceleration space, and the magnetic channel is attached to an end portion on an inner peripheral side of the position adjustment mechanism. That is, for example, the magnetic channel is held by the casing of the vacuum chamber via the position adjustment mechanism.

SUMMARY

According to an embodiment of the present invention, there is provided a cyclotron which accelerates a charged particle in an orbital trajectory to emit a charged particle beam. The cyclotron includes a magnetic pole that generates a magnetic field required for accelerating the charged particle, and a magnetic channel portion having a magnetic channel disposed on an outer peripheral portion of the orbital trajectory to guide the charged particle beam to an extraction trajectory and to focus the charged particle beam. The magnetic channel portion is attached to the magnetic pole.

DETAILED DESCRIPTION

However, in order to generate a predetermined magnetic gradient with high accuracy, a magnetic channel needs to be positioned so that an installation position is highly accurate. It is desirable to provide a cyclotron which improves position accuracy of the magnetic channel.

A magnetic channel portion may have a radial positioning portion that positions a relative position of the magnetic channel with respect to a magnetic pole in a radial direction of the magnetic pole, and a circumferential positioning portion that positions the relative position of the magnetic channel with respect to the magnetic pole in a circumferential direction of the magnetic pole.

Hereinafter, an embodiment of a magnetic channel and a cyclotron according to the present invention will be described in detail with reference to the drawings. In a cyclotron 1 of the present embodiment, it is assumed that a spiral orbital trajectory B of a charged particle is present on a horizontal plane. The cyclotron of the present invention may be disposed so that the orbital trajectory B is present on a vertical plane.

Figure 1:
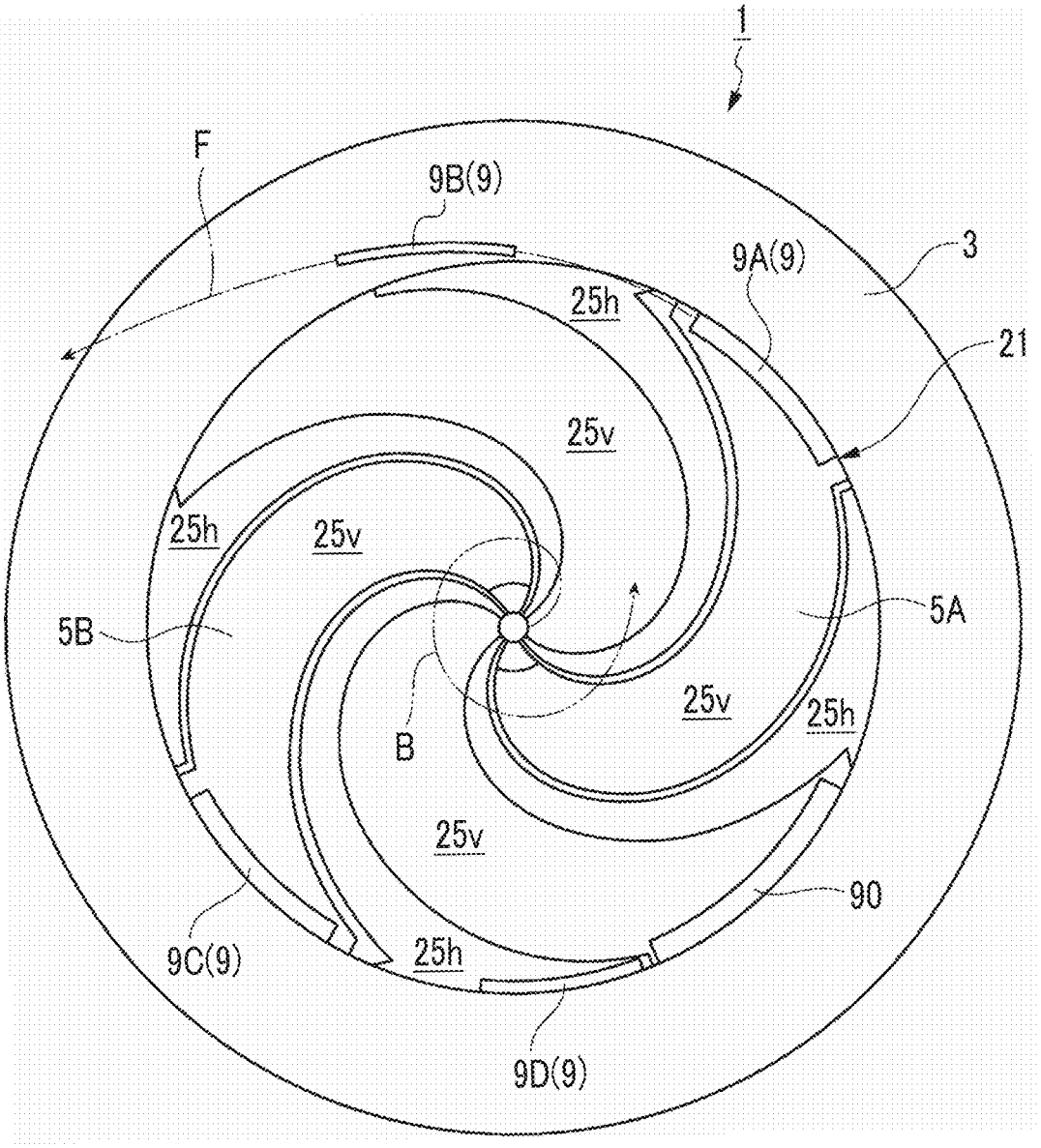
FIG. 1 is a plan view illustrating an interior of a cyclotron according to an embodiment of the present invention.

As illustrated in FIG. 1, the cyclotron 1 has a vacuum chamber 3, Dee-electrodes 5A and 5B, an electrostatic deflector 90, and a magnetic channel 9. The vacuum chamber 3 is a container for holding an acceleration space of the charged particle in a high vacuum state. The vacuum chamber 3 internally has a pair of magnetic poles 21 and 23 for forming a magnetic field required for particle acceleration. The magnetic poles 21 and 23 have a circular shape in a plan view, and have a shape in which upper and lower surfaces are symmetrical with respect to a median plane which is an acceleration plane. In addition, the magnetic poles 21 and 23 are disposed to face each other in an upward-downward direction (direction perpendicular to a paper surface in FIG. 1) while the orbital trajectory B of the charged particle is interposed therebetween. A coil is disposed around each of the magnetic poles 21 and 23, and the magnetic field is generated between the magnetic pole 21 and the magnetic pole 23.

Figure 2:
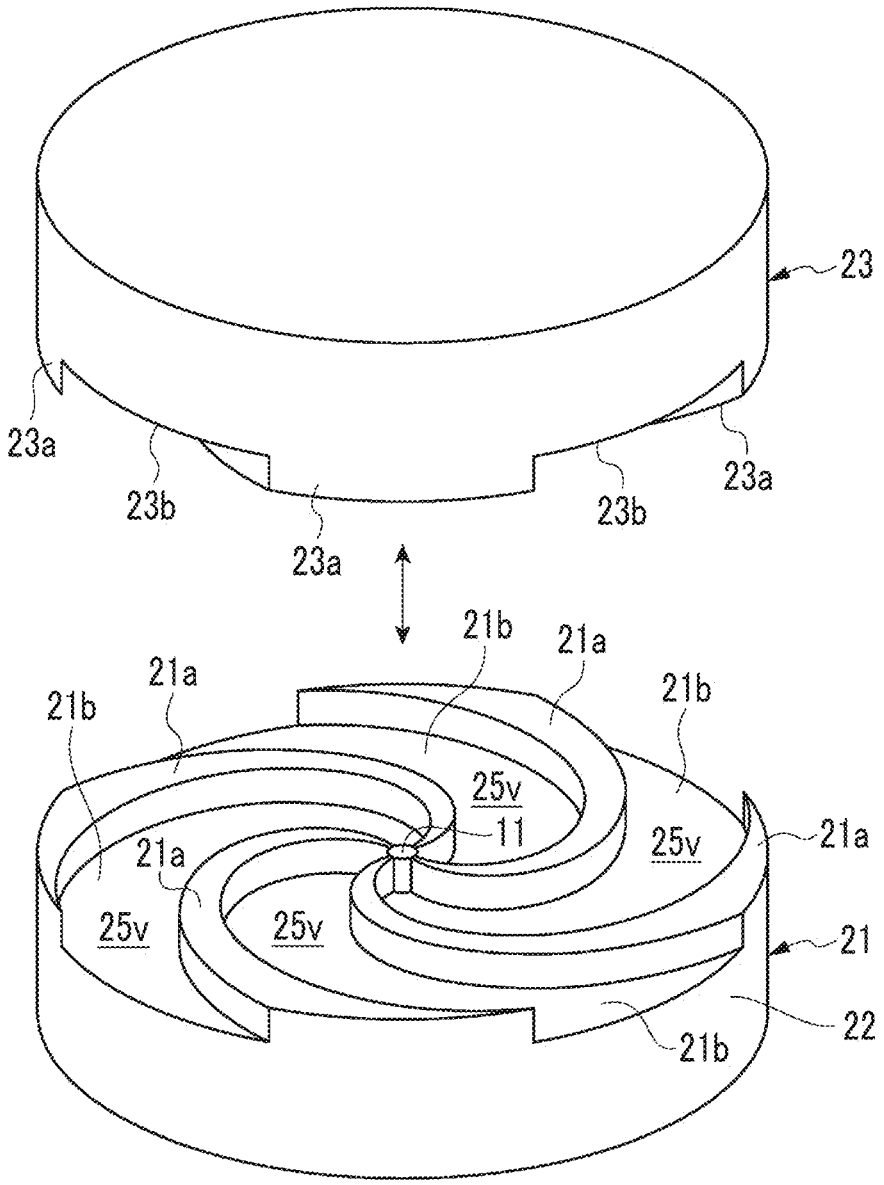
FIG. 2 is a schematic view illustrating a pair of magnetic poles included in the cyclotron illustrated in FIG. 1.

FIG. 2 is a perspective view schematically illustrating only the magnetic poles 21 and 23. As illustrated in the drawing, the magnetic poles 21 and 23 have a cylindrical shape. The terms of a "radial direction" and a "circumferential direction" which are used below mean a radial direction and a circumferential direction of a circle that is a contour shape of the magnetic poles 21 and 23 when viewed in a direction of FIG. 1. On an upper surface of the magnetic pole 21, four spirally curved protrusions 21*a* and four recessed portions 21*b* are formed to be alternately arrayed in the circumferential direction. Then, on a lower surface of the magnetic pole 23, four spirally curved protrusions 23*a* and four recessed portions 23*b* are formed to be alternately arrayed in the circumferential direction. The protrusion 21*a* and the protrusion 23*a*, and the recessed portion 21*b* and the recessed portion 23*b* are disposed with a gap to mutually form plane symmetry with respect to the median plane.

Here, the protrusions 21*a* and 23*a* of the magnetic poles 21 and 23 are portions that protrude toward the median plane, and the recessed portions 21*b* and 23*b* are portions that are recessed away from the median plane. In addition, the median plane is a plane on which the orbital trajectory B where a charged particle beam travels by being accelerated is located. Strictly, the charged particle beam travels while oscillating in a direction in which the magnetic poles 21 and 23 face each other (upward-downward direction in FIG. 2). Accordingly, a plane obtained by calculating a position and a median value of the oscillating charged particle beam in the direction in which the magnetic poles 21 and 23 face each other is the median plane. Each shape of the protrusions 21*a* and 23*a* and the recessed portions 21*b* and 23*b* is not limited to the spirally curved shape as described above, and may be a fan shape.

A hill region 25*h* having a narrow gap interposed between the protrusion 21*a* and the protrusion 23*a* and a valley region 25*v* having a wide gap interposed between the recessed portion 21*b* and the recessed portion 23*b* are formed between the magnetic pole 21 and the magnetic pole 23. The spiral orbital trajectory B of the charged particle is formed on a symmetry plane between the magnetic poles 21 and 23.

The Dee-electrodes 5A and 5B are electrodes that generate an electric field for accelerating the charged particle inside the vacuum chamber 3. Both the Dee-electrodes 5A and 5B are disposed in the valley region 25*v*, and disposed to face each other in the radial direction. The Dee-electrodes 5A and 5B are formed in a shape along a shape of the valley region 25*v* in a plan view. A central portion of the magnetic pole 21 has an inflector 11 that deflects charged particle fed from an ion source (not illustrated) provided outside or inside the cyclotron 1 and feeds the charged particle onto the median plane. However, in a case of an internal ion source, the inflector 11 is not provided, since charged particle comes out on the median plane.

The electrostatic deflector 90 has a function to deflect the charged particle orbiting the orbital trajectory B in the magnetic field so that the charged particle is extracted to an extraction trajectory F. As the magnetic channel 9, four of magnetic channels 9A and 9B and counter magnetic channels 9C and 9D are provided.

The magnetic channels 9A and 9B have both functions including a function to focus the charged particle beam in a horizontal direction by using a predetermined magnetic field gradient and a function to weaken an average magnetic field itself so that the charged particle beam is guided and transferred to the extraction trajectory F. The above-described "horizontal direction" serving as a direction in which the magnetic channels 9A and 9B focus the charged particle beam is a substantially radial direction, more strictly, is a direction perpendicular to a traveling direction of the charged particle beam, and is a direction perpendicular to a facing direction of the magnetic poles 21 and 23. The magnetic channel 9A is disposed at a position corresponding to an outermost peripheral portion of the orbital trajectory B in a plan view. The magnetic channel 9B is provided on a downstream side away from the magnetic channel 9A in the orbital trajectory B of the charged particle. The magnetic channel 9B is located outside the magnetic poles 21 and 23 in a plan view.

The counter magnetic channel 9C is disposed at a substantially symmetrical position with respect to the magnetic channel 9A, based on a center position (for example, a position of the inflector 11) of the magnetic pole 21. Similarly, the counter magnetic channel 9D is disposed at a substantially symmetrical position with respect to the magnetic channel 9B, based on the center position of the magnetic pole 21. The counter magnetic channels 9C and 9D are provided with respect to the magnetic channels 9A and 9B as described above. In this manner, dyad symmetry of the magnetic field of the orbital trajectory B is maintained.

In the cyclotron 1, a magnetic field is generated between the magnetic pole 21 and the magnetic pole 23, and a high frequency voltage is applied to the Dee-electrodes 5A and 5B. In this manner, while the charged particle is accelerated, the charged particle travels in the spiral orbital trajectory B on the median plane. The charged particle arriving at a position of the outer peripheral portion of the magnetic poles 21 and 23 is separated from the orbital trajectory by the electrostatic deflector 90. The charged particle further passes through an introduction gap of the magnetic channels 9A and 9B, and is repeatedly deflected and focused. Thereafter, the charged particle is extracted outward and emitted through abeam extraction duct.

Subsequently, configurations of the magnetic channels 9A and 9B and the counter magnetic channels 9C and 9D will be described. The four magnetic channels 9 have mutually the same configuration. Thus, hereinafter, the magnetic channel 9B will be described, and repeated description will be omitted.

Figure 3:
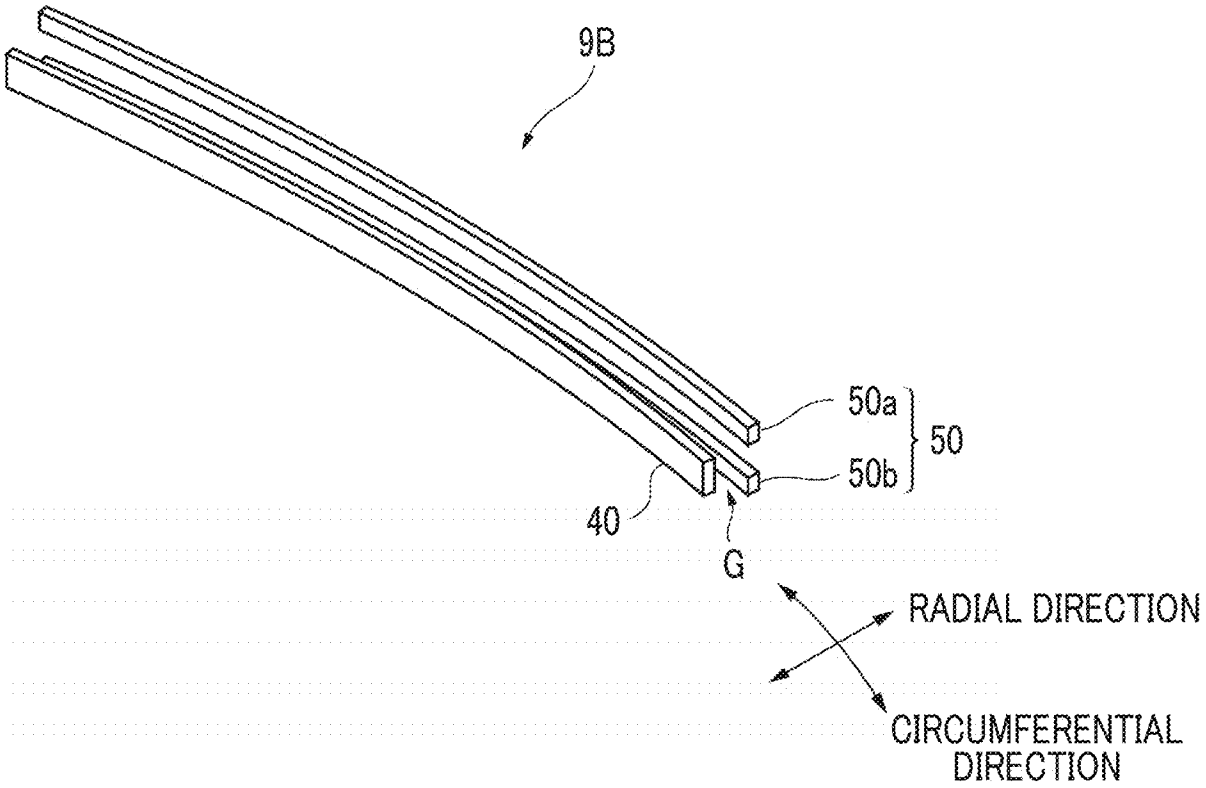
FIG. 3 is a perspective view of a magnetic channel.

FIG. 3 is a perspective view illustrating a main portion of the magnetic channel 9B. As illustrated in FIG. 3, the magnetic channel 9B includes a curved inner peripheral side magnetic member 40 and an outer peripheral side magnetic member 50 located on an outer peripheral side from the inner peripheral side magnetic member 40 and curved similarly to the inner peripheral side magnetic member 40. The outer peripheral side magnetic member 50 is configured to include two magnetic members 50*a* and 50*b* aligned in the upward-downward direction. A curved gap G formed between the inner peripheral side magnetic member 40 and the outer peripheral side magnetic member 50 is a passage for the charged particle beam. According to the inner peripheral side magnetic member 40 and the outer peripheral side magnetic member 50 which are formed in this way, a focusing type (radial focusing type) magnetic channel is configured to focus the charged particle beam passing through the gap G in the radial direction. The inner peripheral side magnetic member 40 and the outer peripheral side magnetic member 50 are formed of a magnetic material such as pure iron and cobalt iron, for example. In practice, the magnetic channel 9B includes a support structure that supports the inner peripheral side magnetic member 40 and the outer peripheral side magnetic member 50 or a cooling medium flow path for cooling both of these. However, illustration and description thereof will be omitted.

The magnetic channels 9A and 9B and the counter magnetic channels 9C and 9D need to receive a main magnetic field from the magnetic poles 21 and 23 so as to generate a predetermined magnetic gradient with high accuracy. Therefore, it is required that relative positions of the magnetic channels 9A and 9B and the counter magnetic channels 9C and 9D with respect to the magnetic poles 21 and 23 are positioned with high accuracy (for example, within an error of 0.1 mm). Therefore, in the cyclotron 1, at least one of the magnetic channels 9A and 9B and the counter magnetic channels 9C and 9D adopts an installation structure for positioning the relative positions with respect to the magnetic poles 21 and 23 with high accuracy. In the present embodiment, it is assumed that the above-described installation structure is adopted for two of magnetic channel 9B and the counter magnetic channel 9D.

Figure 4:
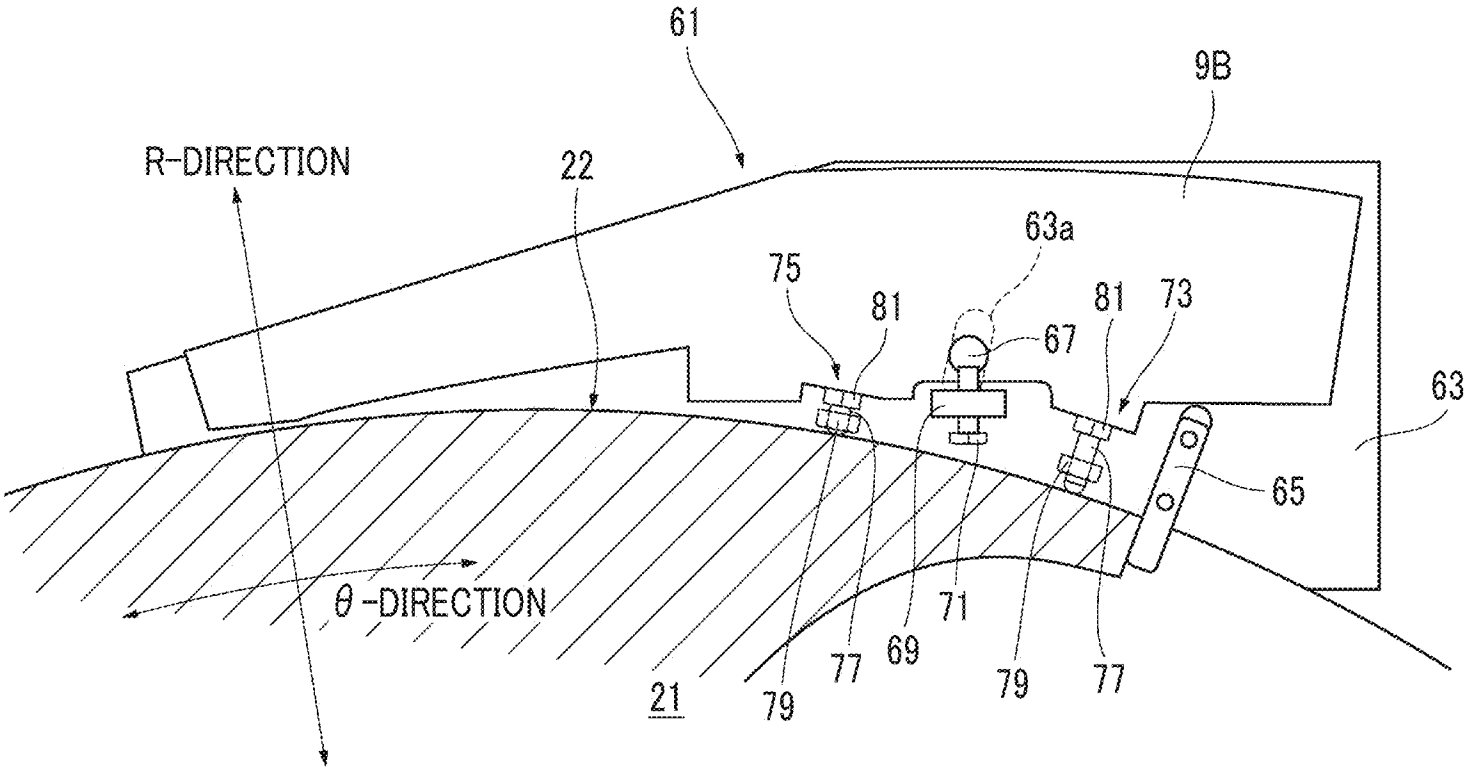
FIG. 4 is a plan view illustrating an end portion of the magnetic pole.

Hereinafter, the above-described installation structure adopted for the magnetic channel 9B and the counter magnetic channel 9D will be described. Both of these have mutually the same installation structure. Thus, hereinafter, the installation structure of the magnetic channel 9B will be described, and repeated description will be omitted. FIG. 4 is a plan view illustrating an end portion on the outer peripheral side of the magnetic pole 21, in which the magnetic channel 9B is disposed. In FIG. 4, a detailed portion of the magnetic channel 9B is omitted from the drawing, and only an outline is illustrated.

In the cyclotron 1, a magnetic channel portion 61 including the magnetic channel 9B is attached to and supported by the magnetic pole 21. Specifically, as illustrated in FIG. 4, the magnetic channel portion 61 is attached to an outer peripheral side surface 22 of the magnetic pole 21 having a cylindrical surface. The magnetic channel portion 61 includes an SUS plate 63 attached to the outer peripheral side surface 22, and the magnetic channel 9B installed on an upper surface of the SUS plate 63.

In addition, the magnetic channel portion 61 includes the following mechanism for positioning and adjusting a position of the magnetic channel 9B with respect to the magnetic pole 21. In the following description, an Re-polar coordinate system is assumed in which a center position of the magnetic pole 21 is set as an origin in a plan view, and the radial direction will be defined as an "R-direction", and the circumferential direction will be defined as a "θ-direction".

A θ-positioning member 65 (circumferential positioning portion) is attached to the upper surface of the SUS plate 63 to protrude toward the magnetic pole 21. A θ-position of the SUS plate 63 relative to the magnetic pole 21 is accurately positioned by bringing the θ-positioning member 65 into close contact with a predetermined position (for example, a sector side surface of the magnetic pole 21) on the outer peripheral portion of the magnetic pole 21. In addition, a pin 67 is provided which penetrates both the magnetic channel 9B and the SUS plate 63 in the upward-downward direction (direction perpendicular to a paper surface in FIG. 4). The pin 67 is accurately fitted to the magnetic channel 9B and the SUS plate 63 in the θ-direction. In this manner, the θ-position of the magnetic channel 9B relative to the SUS plate 63 is accurately positioned. According to the above-described configuration, the θ-position of the magnetic channel 9B relative to the magnetic pole 21 is accurately positioned.

A through-hole for the pin 67 formed in the SUS plate 63 is a long hole 63*a* extending in the R-direction, and an R-position of the magnetic channel 9B relative to the SUS plate 63 is not restricted by the pin 67. A guide 69 is fixed to the upper surface of the SUS plate 63, a screw 71 extending substantially in the R-direction is screwed to the guide 69, and a tip of the screw 71 abuts the side surface of the pin 67. When the screw 71 is turned, the pin 67 follows the tip of the screw 71 and is guided by the long hole 63*a* to move in the R-direction together with the entire magnetic channel 9B. With such a mechanism, the magnetic channel 9B can be finely moved only in the R-direction.

Further, in order to perform relative positioning of the magnetic channel 9B in the R-direction with respect to the magnetic pole 21, the magnetic channel 9B is provided with R-positioning portions 73 and 75 (radial positioning portions) at two locations. The R-positioning portions 73 and 75 are lined up in the θ-direction, and the pin 67 described above exists between the R-positioning portions 73 and 75. The R-positioning portion 73 includes a rod member 77 protruding in the R-direction from the magnetic channel 9B toward the magnetic pole 21 side. The tip of the rod member 77 abuts against the outer peripheral side surface 22 of the magnetic pole 21. A nut 79 engaging with the rod member 77 is turned so that the protrusion amount of the rod member 77 can be adjusted. A nut 81 is fastened so that the protrusion amount of the rod member 77 can be fixed. An R-positioning portion 75 is also provided with the above-described configuration the same as the configuration of the R-positioning portion 73. As described above, the protrusion amount of the rod member 77 is adjusted in the R-positioning portions 73 and 75, and the tip of each rod member 77 abuts against the outer peripheral side surface 22 of the magnetic pole 21. In this manner, the R-position of the magnetic channel 9B relative to the magnetic pole 21 is accurately positioned.

In addition, the protrusion amount of each rod member 77 in the R-positioning portions 73 and 75 can be individually adjusted. Accordingly, for example, highly accurate positioning and position adjustment can also be performed on a position of the magnetic channel 9B in a rotation direction within an Re-plane around the position of the pin 67.

Subsequently, an operational effect of the cyclotron 1 will be described. As disclosed in the related art, in a case of adopting a method in which the magnetic channel is held via the position adjustment mechanism provided outside the acceleration space, for example, position errors of respective portions of the position adjustment mechanism are accumulated. In this manner, it is conceivable that the position accuracy of the magnetic channel relative to the magnetic pole cannot be sufficiently obtained. In contrast, in the cyclotron 1, the magnetic channel portion 61 is attached to the magnetic pole 21. Accordingly, the relative positions (R-position and θ-position) of the magnetic channel 9B with respect to the magnetic pole 21 can be directly positioned. As a result, the positioning can be performed with high accuracy.

In addition, a case is conceivable where the magnetic channel 9B is held in the casing of the vacuum chamber 3. As described above, the vacuum chamber 3 is internally evacuated in order to bring the acceleration space of the charged particle into a high vacuum state. In that case, distortion occurs in the casing of the vacuum chamber 3 due to the evacuation, thereby affecting the position accuracy of the magnetic channel 9B held in the casing. In contrast, in the cyclotron 1, the magnetic channel portion 61 is attached to the magnetic pole 21. Then, the magnetic pole 21 has extremely higher rigidity, compared to the casing of the vacuum chamber 3, and distortion caused by the evacuation is extremely small. Therefore, even when the cyclotron 1 is used, high position accuracy of the magnetic channel 9B can be maintained.

The present invention can start from the above-described embodiment, and can be implemented in various forms including various modifications and improvements, based on the knowledge of those skilled in the art. In addition, a modification example can be configured by utilizing technical matters described in the above-described embodiment. The configurations of the respective embodiments may be appropriately used in combination with each other. For example, the magnetic channel portion 61 may be attached to the magnetic pole 23 instead of the magnetic pole 21.

It should be understood that the invention is not limited to the above-described embodiment, but may be modified into various forms on the basis of the spirit of the invention. Additionally, the modifications are included in the scope of the invention.

What is claimed is:

1. A cyclotron which accelerates a charged particle in an orbital trajectory to emit a charged particle beam, the cyclotron comprising:

a magnetic pole that generates a magnetic field required for accelerating the charged particle; and a magnetic channel portion having a magnetic channel disposed on an outer peripheral portion of the orbital trajectory to guide the charged particle beam to an extraction trajectory and to focus the charged particle beam, wherein the magnetic channel portion is attached to the magnetic pole, and wherein the magnetic channel includes a first magnetic channel disposed at a position corresponding to an outermost peripheral portion of the orbital trajectory, a second magnetic channel disposed on a downstream side away from the first magnetic channel in the orbital trajectory, a first counter magnetic channel disposed at a symmetrical position with respect to the first magnetic channel, based on a center position of the magnetic pole, and a second counter magnetic channel disposed at a symmetrical position with respect to the second magnetic channel, based on the center position of the magnetic pole.

2. The cyclotron according to claim 1, further comprising:

an electrostatic deflector that deflects the charged particle orbiting the orbital trajectory and extracts the charged particle to the extraction trajectory.

3. The cyclotron according to claim 1, wherein the magnetic channel includes a curved inner peripheral side magnetic member, and an outer peripheral side magnetic member located on an outer peripheral side from the inner peripheral side magnetic member and curved similarly to the inner peripheral side magnetic member, and wherein the charged particle beam passes through a curved gap formed between the inner peripheral side magnetic member and the outer peripheral side magnetic member.

4. The cyclotron according to claim 3, wherein the outer peripheral side magnetic member is formed of two magnetic members aligned in an upward-downward direction.

5. The cyclotron according to claim 1, wherein the magnetic channel portion is capable of adjusting a relative position of the magnetic channel with respect to the magnetic pole.

6. A cyclotron which accelerates a charged particle in an orbital trajectory to emit a charged particle beam, the cyclotron comprising:

a magnetic pole that generates a magnetic field required for accelerating the charged particle; and a magnetic channel portion having a magnetic channel disposed on an outer peripheral portion of the orbital trajectory to guide the charged particle beam to an extraction trajectory and to focus the charged particle beam, wherein the magnetic channel portion is attached to the magnetic pole, and wherein the magnetic channel portion has a radial positioning portion that positions a relative position of the magnetic channel with respect to the magnetic pole in a radial direction of the magnetic pole, and a circumferential positioning portion that positions a relative position of the magnetic channel with respect to the magnetic pole in a circumferential direction of the magnetic pole.

7. The cyclotron according to claim 6, wherein the magnetic channel portion further includes a plate attached to an outer peripheral side surface of the magnetic pole, and wherein the magnetic channel is disposed on an upper surface of the plate.

8. The cyclotron according to claim 7, wherein the circumferential positioning portion is attached to protrude toward the magnetic pole side on the upper surface of the plate, and is brought into close contact with a predetermined position of an outer peripheral portion of the magnetic pole.

9. The cyclotron according to claim 7, further comprising:

a pin penetrating both the magnetic channel and the plate in an upward-downward direction.

10. The cyclotron according to claim 9, wherein the pin is fitted to the magnetic channel and the plate in a circumferential direction of the magnetic pole so that the relative position of the magnetic channel with respect to the plate is positioned in the circumferential direction of the magnetic pole.

11. The cyclotron according to claim 9, wherein a through-hole for the pin formed in the plate is a long hole extending in the radial direction of the magnetic pole, and wherein the relative position of the magnetic channel with respect to the plate is not restricted by the pin in the radial direction of the magnetic pole.

12. The cyclotron according to claim 11, further comprising:

a guide fixed to an upper surface of the plate; and a screw screwed to the guide and extending in the radial direction of the magnetic pole, wherein a tip of the screw abuts against a side surface of the pin, and wherein the screw is turned so that the pin follows the tip of the screw, is guided to the long hole, and moves in the radial direction of the magnetic pole together with the magnetic channel.

13. The cyclotron according to claim 9, wherein the radial positioning portion includes a rod member protruding from the magnetic channel toward the magnetic pole side in the radial direction of the magnetic pole, and having a tip colliding with an outer peripheral side surface of the magnetic pole, and a nut engaging with the rod member, wherein the nut is turned to adjust a protrusion amount of the rod member, and wherein the nut is fastened to fix the protrusion amount of the rod member.

14. The cyclotron according to claim 13, further comprising:

another radial positioning portion that positions the relative position of the magnetic channel with respect to the magnetic pole in the radial direction of the magnetic pole, wherein the radial positioning portion and the other radial positioning portion are aligned and disposed in a circumferential direction of the magnetic pole in the magnetic channel, and the pin is disposed between the radial positioning portion and the other radial positioning portion.

* * * * *